United States Patent [19]

Coleman

[11] Patent Number: 4,847,950

[45] Date of Patent: Jul. 18, 1989

[54] SELF RETAINED AXLE PIN ASSEMBLY FOR SHEAR APPLICATION

[75] Inventor: Michael D. Coleman, Indianapolis, Ind.

[73] Assignee: Von Duprin, Inc., Indianapolis, Ind.

[21] Appl. No.: 198,622

[22] Filed: May 20, 1988

Related U.S. Application Data

[63] Continuation of Ser. No. 891,551, Aug. 1, 1986, abandoned.

[51] Int. Cl.[4] ..... E05D 7/10

[52] U.S. Cl. ..... 16/363; 16/97; 16/381; 16/386; 24/704.1; 403/326

[58] Field of Search ..... 16/97, 228, 261, 262, 16/263, 381, 386; 403/326, DIG. 4; 24/297, 617, 704

[56] References Cited

U.S. PATENT DOCUMENTS

| | | | |
|---|---|---|---|
| 1,433,379 | 10/1922 | Kiesel, Jr. | 16/386 |
| 2,610,879 | 9/1952 | Pope | 24/704 X |
| 3,013,297 | 12/1961 | Ferry | 16/381 |
| 3,367,701 | 2/1968 | Wenk, Jr. | 24/704 X |
| 3,703,741 | 11/1972 | Foster et al. | 16/263 X |
| 4,345,848 | 8/1982 | Cheselka | 16/263 X |
| 4,559,679 | 12/1985 | Downey | 24/617 X |

FOREIGN PATENT DOCUMENTS

| | | | |
|---|---|---|---|
| 1220673 | 7/1966 | Fed. Rep. of Germany | 24/297 |

*Primary Examiner*—Fred A. Silverberg
*Attorney, Agent, or Firm*—Walter C. Vliet

[57] ABSTRACT

The assembly comprises two, snap-together pieces which, following their clinched or latched engagement, are freely rotatable relative to each other. One of the two pieces comprises a sleeve which has an inner annular land, and the other of the two pieces comprises a rod having flexible extending fingers which terminate in outwardly-directed, land-engaging and latching lugs. The rod is slid into the sleeve, with the lug-ended fingers entering first, and, consequently, the fingers are resiliently forced inwardly until the lugs reach the land. Then the fingers spring outwardly while the lugs latch onto the land. This latching together of the pieces requires no tools.

13 Claims, 1 Drawing Sheet

SELF RETAINED AXLE PIN ASSEMBLY FOR SHEAR APPLICATION

This application is a continuation of application Ser. No. 891,551 filed 8-01-86 now abandoned.

This invention pertains to axle assemblies of the type commonly employed as hinge or pivot pins, and in particular to such assemblies which comprise separate, engageable parts.

Prior art axle assemblies use separable parts which require tools to affect an assembly thereof into an engaged unit. By way of example, axle assemblies are used to pivotably mount arms of levers of panic exit devices to the center and end cases thereof. However, such prior art axle assemblies experience failure, i.e., separation, due to twisting, vibration, etc.

It is an object of this invention to set forth an axle assembly which is less subject to the aforesaid disadvantages, and which requires no tools for assembly into a completed unit.

It is particularly an object of this invention to set forth an axle assembly, for use as a pivot pin, or hinge pin, or the like, comprising a sleeve; said sleeve having means defining a land; and a rod; wherein said rod has means for (a) latchingly engaging said land and, thereby, (b) interlocking said sleeve and said rod.

Further objects of this invention, as well as the novel features thereof will become more apparent by reference to the following description taken in conjunction with the accompanying figures, in which.

Figure 1:
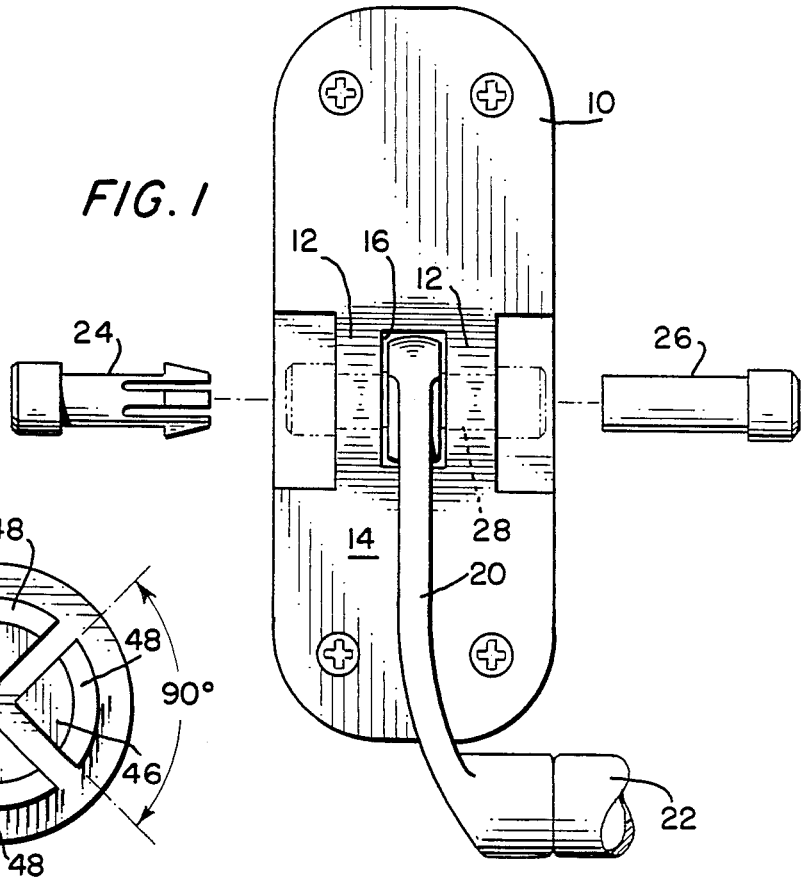
FIG. 1 is a front view of an end case and lever arm, of a panic exit device, showing an embodiment of the novel axle assembly in exploded view in full line illustration, and fixed in place in phantom.
Figure 3:
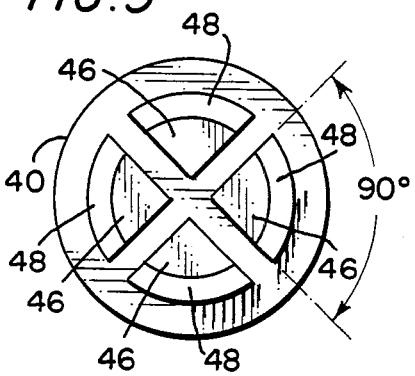
FIG. 3 is an end view of the rod the same taken from the right-hand side of the rod in FIG. 2.
Figure 2:
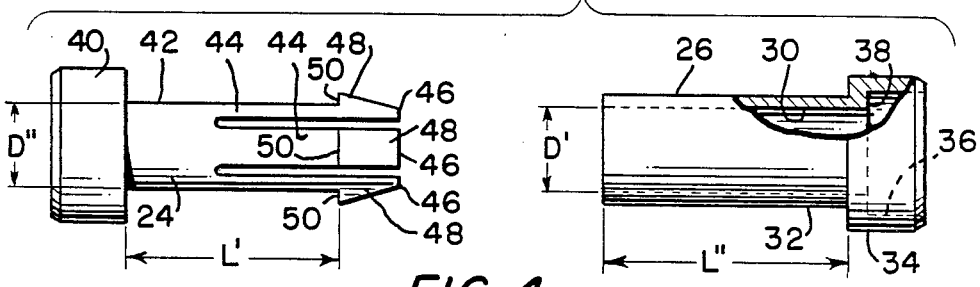
FIG. 2 is an enlarged illustration of the rod and sleeve, the two shown in spaced-apart alignment.

As shown in the figures, an end case 10 has a pair of bored-through, semi-circular lobes 12 raised upon the surface 14 of the case 10. The lobes 12 are spaced apart to define a channel 16 in which to receive the bored-through end 18 of an arm 20 of a lever 22 (shown only in part) of a panic exit device. The novel axle assembly is used to pivotably fix the end 18 to the case 10.

The rod 24 is received in the sleeve 26, and the two pieces snap together to define an axle 28 which penetrates the arm end 18 and the lobes 12.

The sleeve 26, being hollow, has an inside surface 30 along the shank 32 thereof, and an enlarged, shell-type head 34 with an external, beveled edge, and an inner circular wall 36. An annular land 38 joins the surface 30 and the wall 36.

The rod 24 has an enlarged head 40 at an end thereof which is also beveled like head 34, and is of the same diameter and depth or axial length. Unlike head 34 though, head 40 is solid. A shank 42 having a length L′ extends from the head 40 and transforms into four, flexible, spaced-apart fingers 44. Each finger 44 has a terminal lug 46 which has a tapered exterior 48 and a sectored shoulder 50. Each shoulder 50 subtends an arc of approximately ninety degrees.

The rod 24 is pressed into the sleeve 26, with the fingers 44 making the entry, and, as a consequence, the fingers 44 flex inwardly until the shoulders 50 reach the land 38 in head 34 of the sleeve 26. Then the fingers 44 spring outwardly as the shoulders 50 latch into engagement with the land 38.

Within the sleeve 26 is a shank inside diameter D′ which is just a little larger than the rod's shank outside diameter D″. Also, the length L″ of the shank 32 of the sleeve 26 is not quite sufficient to allow the end thereof to contact the underside of the head 40 of the rod 24. The sleeve end comes into a very near proximity, but only that. Thus, upon the rod 24 and sleeve 26 being latched together, the two can freely rotate relative to each other. Latched together, the rod 24 and sleeve 26 do not become a rigidly joined unit. Even so, they are substantially inseparable without the aid of a tool. The invention also comprises the provisioning of a tool for the separation of the rod 24 and sleeve 26.

Figure 4:
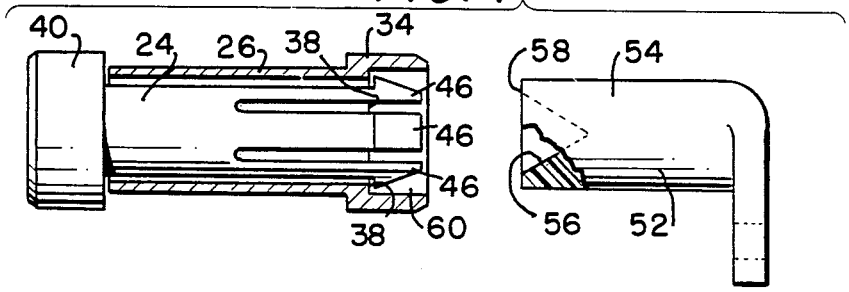
FIG. 4 is a side view of the rod and sleeve in latched engagement, with the sleeve shown in cross-section, in apposition with the separator tool.

The tool, a separator 52, is shown in FIG. 4. It is of right-angular shape and, in this embodiment, is of plastic material. It has a cylindrical body 54 which has a conical recess 56 formed in an end thereof. The recess 56 defines a narrow, circular rim 58 which is receivable in an annular space 60 obtaining between the lug exteriors 48 and the wall 36. By forcing the rim 58 into the head 34, the recess 56 draws the lugs 46 together until they unlatch from the land 38 and, in fact, the separator 52 proceeds to push the rod 24 out of the sleeve 26.

While I have described my invention in connection with a specific embodiment thereof, it is to be clearly understood that this is done only by way of example, and not as a limitation to the scope of my invention as set forth in the objects thereof, and in the appended claims.

I claim:

1. A self retained two piece axle assembly, for use as a pivot pin, or hinge pin, comprising: a bearing forming an axle in the form of a hollow cylinder sleeve and having a bearing surface thereon; said sleeve having means defining a land at its one end; and a rod for substantially full length disposal within said sleeve via the other end of said sleeve; said rod having means for (a) latchingly engaging said land and thereby, (b) interlocking said sleeve and said rod; said sleeve and said rod each have an enlarged head; said head of said sleeve confines said land therewithin; and said sleeve has an inside diameter of a given dimension; and said rod has an outside diameter of substantially said given dimension for close diametral fit; said rod having said means for latchingly engaging said land at its one end and said enlarged head at its other end, whereupon in a locked assembly said sleeve being in close proximity to but spaced from said enlarged head said enlarged head on said sleeve and said enlarged head on said rod confine said bearing surface therebetween with said sleeve and said rod being freely rotatable relative to each other and said bearing surface being internally reinforced.

2. An axle assembly, according to claim 1, wherein
said engaging and interlocking means comprises an elongate, flexible finger; and
said finger has means defining a latch.

3. An axle assembly, according to claim 2, wherein:
said engaging and interlocking means comprises a plurality of said fingers.

4. An axle assembly, according to claim 3, wherein:
said fingers lie in parallel with spaces therebetween.

5. An axle assembly, according to claim 4, wherein:

each of said fingers has a terminal lug with (a) an outwardly-facing, tapered exterior, and (b) a sectored shoulder.

6. An axle assembly, according to claim 5, further including:

a separator for unlatching said rod from said sleeve; wherein said separator has means for (a) engaging said tapered exteriors of said lugs, and (b) moving said lugs toward each other.

7. An axle assembly, according to claim 6, wherein:

said engaging and moving means of said separator comprises a conical recess formed in an end thereof.

8. An axle assembly, according to claim 1, wherein:

said sleeve has an inside diameter surface;

said head of said sleeve comprises a hollow shell having a circular, inner wall; and said land (a) is of annular conformation, and (b) joins said wall and said surface.

9. An axle assembly, according to claim 1, wherein:

said rod has a shank, intermediate said enlarged head at an end thereof and said engaging and interlocking means, of a given length; and said sleeve has a shank, extending from said land-confining head thereof, of substantially said given length.

10. An axle assembly, according to claim 1, wherein:

said heads are of common outside diameter, of common depth or axial extent, and have a common, beveled edge.

11. An axle assembly, according to claim 1, further including:

a separator for unlatching said rod from said sleeve.

12. An axle assembly, according to claim 11, wherein:

said separator has means for interpositioning thereof between said sleeve and said engaging and interlocking means of said rod.

13. An axle assembly, according to claim 11, wherein:

said separator has means for displacing said engaging and interlocking means of said rod relative to said sleeve.

* * * * *